US006786781B2

(12) United States Patent
Sai et al.

(10) Patent No.: US 6,786,781 B2
(45) Date of Patent: Sep. 7, 2004

(54) MALE CONTACT

(75) Inventors: Noriaki Sai, Kawasaki (JP); Toshiaki Kohno, Kawasaki (JP); Masanori Wakui, Toyota (JP); Keiichi Itou, Toyota (JP); Kazuyuki Shiraki, Toyota (JP); Atushi Nishida, Toyota (JP)

(73) Assignees: Tyco Electronics AMP, K.K., Kanagawa (JP); Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 10/332,090

(22) PCT Filed: Jul. 5, 2001

(86) PCT No.: PCT/JP01/05841

§ 371 (c)(1),
(2), (4) Date: Jan. 3, 2003

(87) PCT Pub. No.: WO02/03504

PCT Pub. Date: Jan. 10, 2002

(65) Prior Publication Data

US 2003/0119383 A1 Jun. 26, 2003

(30) Foreign Application Priority Data

Jul. 5, 2000 (JP) ..... 2000-203541

(51) Int. Cl.[7] ..... H01R 9/24; H01R 13/02
(52) U.S. Cl. ..... 439/884
(58) Field of Search ..... 439/884, 866, 439/601

(56) References Cited

FOREIGN PATENT DOCUMENTS

| | | | |
|---|---|---|---|
| JP | 7-34563 | 12/1993 | ..... H01R/13/04 |
| JP | 07-192793 | 7/1995 | ..... H01R/13/04 |
| JP | 08-162191 | 6/1996 | ..... H01R/11/11 |
| JP | 09-147947 | 6/1997 | ..... H01R/13/04 |
| JP | 10-125376 | 5/1998 | ..... H01R/13/04 |
| JP | 2001-126798 | 5/2001 | ..... H01R/13/04 |
| WO | WO 93/13572 | 7/1993 | ..... H01R/13/04 |
| WO | WO 93-15532 | 8/1993 | ..... H01R/13/02 |

OTHER PUBLICATIONS

Search Report dated Oct. 16, 2001 for PCT/JP01/05841.

*Primary Examiner*—Javaid H. Nasri
(74) *Attorney, Agent, or Firm*—Barley Snyder

(57) ABSTRACT

There is provided a male contact having improved electrical contact reliability with a female contact. The male contact has a mating section capable of being formed compactly using a plate member having a plate thickness satisfying a desired strength requirement. The male contact 1 has a mating section 10 formed in such a manner that two plate members 11 and 12, which individually extend from a base 20, are superimposed on one another by folding on the base 20. The mating section 10 has flat sections 15 extending in a mating direction P, wherein outer surfaces of the two plate members 11-1 and 12-1 are formed flat. A tip 13 of one of the two plate members 12 is folded to overlap a tip 14 of the other plate member 11. This feature makes it hard to open the plate members 11 and 12 when the male contact is mated with the female contact.

9 Claims, 10 Drawing Sheets

Prior Art

MALE CONTACT

FIELD OF THE INVENTION

The present invention relates to a formed male contact for an electrical connector.

BACKGROUND

As shown in FIG. 10 to FIG. 14, a known male contact has a mating section for mating with a female contact on one end of a base and a wire connecting section on another end of the base. The male contact is formed by stamping and forming from a metallic plate.

FIG. 10 is a sectional view of a mating section of the conventional male contact taken along the direction perpendicular to the mating direction as shown in Japanese Toku-Kai-Hei 8-162191. A mating section 10*a* is formed in such a manner that both edge portions 51*a* represented by a broken line in an initial position are folded as shown by the arrows a. Once folded, the edge portions 51*a* abut one another at the center of the plate member 50*a*.

FIG. 11 is a sectional view of a mating section of another conventional male contact taken along the direction perpendicular to the mating direction as shown in Japanese Toku-Kai-Hei 7-192793. A mating section 10*b* is formed in such a manner that both edge portions 51*b* represented by a broken line in an initial position are wound as shown by arrows b, so that both the edge portions 51*b* meet one another at the center of the plate member. Thus, the mating section 10*b* is different from the mating section 10*a* formed by folding of both the edge portions as shown in FIG. 10, and is provided with cavity sections 52*b* and 52*b* at both edges of the mating section 10*b* by winding.

FIG. 12 is a sectional view of a mating section of another conventional male contact taken along the direction perpendicular to the mating direction as shown in Japanese Toku-Kai-Hei 8-162191. A mating section 10*c* is formed in such a manner that a plate member 50*c* represented by a broken line in an initial position is folded along a center axis extending in the mating direction as shown by an arrow c. Both edge portions abut one another at one end of the plate member 50*c* and thereby form a cavity 52*c*.

FIG. 13 is a perspective view showing a mating section of another male contact before folding as taught by Japanese Toku-Kai-Hei 9-147947. A mating section at one end of a base 20*d* is formed in such a manner that plate member 50*d* having a length twice the mating section extending along the mating direction is folded as shown by arrow d at the intermediate section 53*d* in a longitudinal direction the top of the mating section.

FIG. 14 shows another male contact disclosed by the above-mentioned Japanese Patent Publication Gazette. Part (a) of FIG. 14 is a perspective view showing a state of the mating section before bending of the mating section of the male contact. Part (b) of FIG. 14 is a perspective view showing a state of the mating section after the bending of the mating section of the male contact. A mating section 10*e* shown in the part (b) of FIG. 14 is formed by performing bending plate member 50*e* shown in the part (a) of FIG. 14. The bending is performed in such a manner that both edge portions 51*e*, which extend in the mating direction from a base (not illustrated) to a top portion 54*d* of a plate member 50*e*, are folded as shown by arrows e1. Both of the edge portions 51*e* abut one another at the center of the plate member 50*e*, and the edge side of the top portion 54*d* of the plate member is folded as shown by arrows e2 to the base side (not illustrated).

Higher density of loading electric components requires compact male contacts. However, it is difficult to implement the compact mating sections having the conventional aspects as shown in FIG. 10 to FIG. 14 with a plate member having a plate thickness satisfying a desired strength. Specifically, in the event that the mating section 10*a* formed by folding of both the edges as shown in FIG. 10 is formed using a plate member having a plate thickness satisfying a desired strength, a narrower width w (FIG. 10) of the mating section is more difficult to achieve by folding both the edges. Folding of both the edges under these conditions may result in a mating section having a rounded or circular circle cross section. This will cause a contact area with a female contact to be small, and thus there is a possibility of an unreliable electrical contact between the male and female contacts. Further, the mating section 10*b* formed by winding of both edge portions as shown in FIG. 11 has no flat portion on the top thereof, so that a contact area with an resilient contact segment of the female contact is small, and thus it is difficult to enhance a reliability of the electric contact. In the event that the mating section 10*c* formed by folding on the center axis as shown in FIG. 12 is formed using a plate member having a plate thickness satisfying a desired strength with a the narrower width w of the mating section, an arc-like shape results on the folded side. This will cause a contact area with an resilient contact segment of the female contact to be small, and thus it is difficult to enhance a reliability of the electric contact. In the event that the mating section formed by bending by folding to the base side as shown in FIG. 13 needs a plate member having twice length of the mating section extending along the mating direction. This presents a basic problem that the production efficiency is not so good and a yield rate of the materials is low, while the contact area is secured. The mating section 10*c* formed by folding of three points as shown in FIG. 14 is problematic because a possibility that a resilient contact segment of the female contact is damaged by a seam on an upper surface of the mating section, as well as the basic problem that the production efficiency is relatively low.

In view of the foregoing, it is an object of the present invention to provide a male contact solving the above-mentioned problems, or a male contact which has high reliability electric contact with the female contact and has a mating section capable of being formed compactly using a plate member having a plate thickness satisfying a desired strength.

SUMMARY

The present invention provides a male contact formed by folding a metallic plate. The male contact has a base and a mating section adapted to mate with a female contact. A mating section is formed on the contact in such a manner that two plate members, which individually extend from the base, are superimposed on one another by folding on the base. The two plate members superimposed on one another each have a flat section extending in a mating direction and are formed flat on an associated outer surface opposite to surfaces on which the two plate members are in contact with one another. A tip of one of the two plate members is folded to overlap a tip of another.

In the male contact according to the present invention as mentioned above, it is preferable that the mating section has a projecting section on one of the two plate members superimposed on one another. The projecting section projects toward another plate member, and a recess portion adapted to mate said projecting section with said another plate member.

DETAILED DESCRIPTION OF THE PREFERRED EMBODIMENTS

Figure 1:
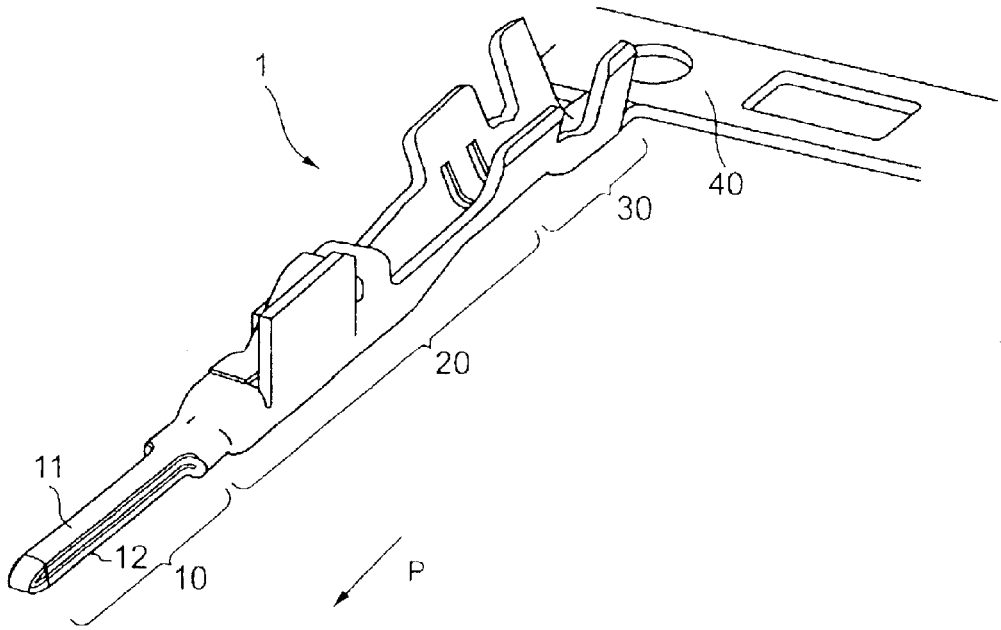
FIG. 1 is a perspective view of a male contact of an embodiment of the present invention.

Embodiments of the present invention will be described hereinafter. Referring to FIG. 1, a male contact 1 is formed by bending a metallic plate such as a copper alloy. The male contact 1 is provided with a mating section 10 at one end of a base 20 and a wire connecting section 30 at another end of the base 20. A plurality of male contacts 1 is coupled with a carrier 40 at another end of the wire connecting section 30, and is separated from the carrier 40 when the male contacts 1 are actually used. The wire connecting section 30 electrically connects wires (not illustrated). The mating section 10 mates with a female contact (not illustrated) in a mating direction P to electrically connect with a resilient contact section (not illustrated) of the female contact. The mating section 10 has two plate members 11 and 12 individually extending from the base 20. Those two plate members 11 and 12 and individually extend along the mating direction P are substantially the same as one anther in geometry except that the tip. The mating section 10 is formed in such a manner that those two plate members 11 and 12 are folded on the base 20 to be superimposed on one another. Thickness (0.64 mm in the present exemplary embodiment) of the mating section 10, which is the narrowest part of the parts of the male contact 1, is about a little longer than twice the plate thickness (0.25 mm in the present exemplary embodiment) of the plate member. Thus, it is possible to implement a compact mating section using the plate member having a plate thickness satisfying a desired strength, and also it is easy in processing. A plurality of male contacts 1 is fixed on an insulating housing (not illustrated) to form an electrical connector.

Figure 7:
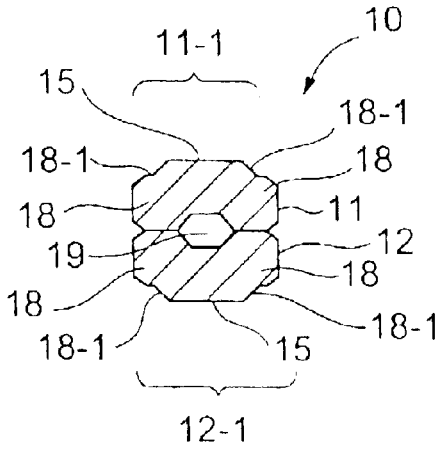
FIG. 7 is a sectional view taken along the line A—A of FIG. 5.

The male contact 1 will now be described using FIG. 2 to FIG. 9 taking the mating section 10 as a leading part. In FIG. 7, flat portions 15 are provided on an upper surface 11-1 of the plate member 11 and a lower surface 12-1 of the plate member 12. The flat portions 15 make it possible, even if the mating of the male contact with the female contact shifts somewhat in right and left directions in FIG. 7, to secure a contact with a resilient contact beam of the female contact and thus to guarantee a desired contact force. Accordingly, the male contact advantageously results in improved reliability of the electric contact with the female contact. As shown in this exemplary embodiment, a cross sectional size of the mating section 10 is for example 0.64 mm×0.64 mm, while the width of the flat section 15 is secured with about 0.3 mm.

Figure 2:
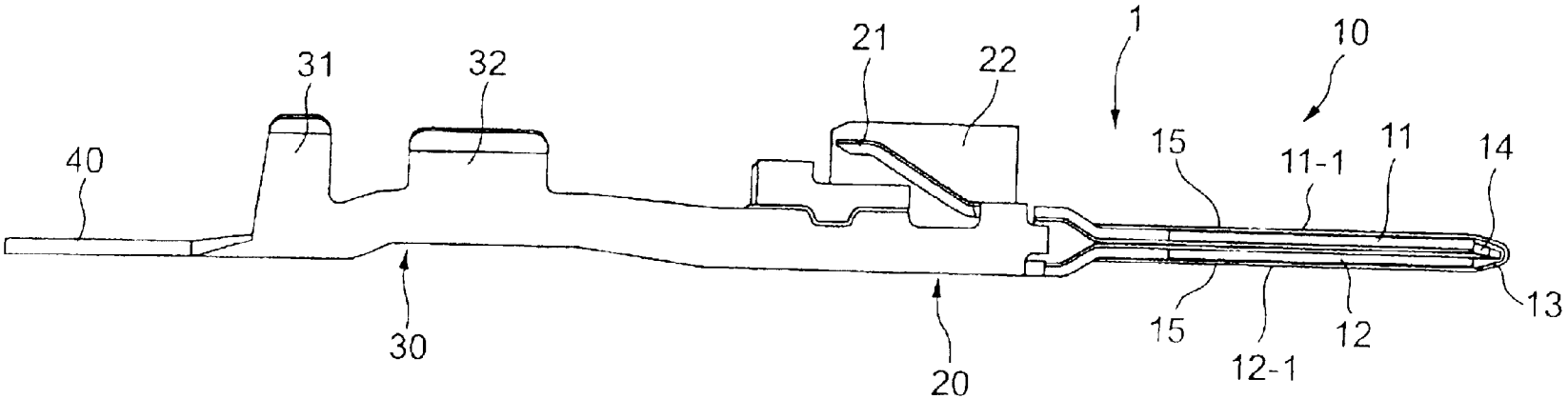
FIG. 2 is a left side elevation of the male contact of FIG. 1.
Figure 3:
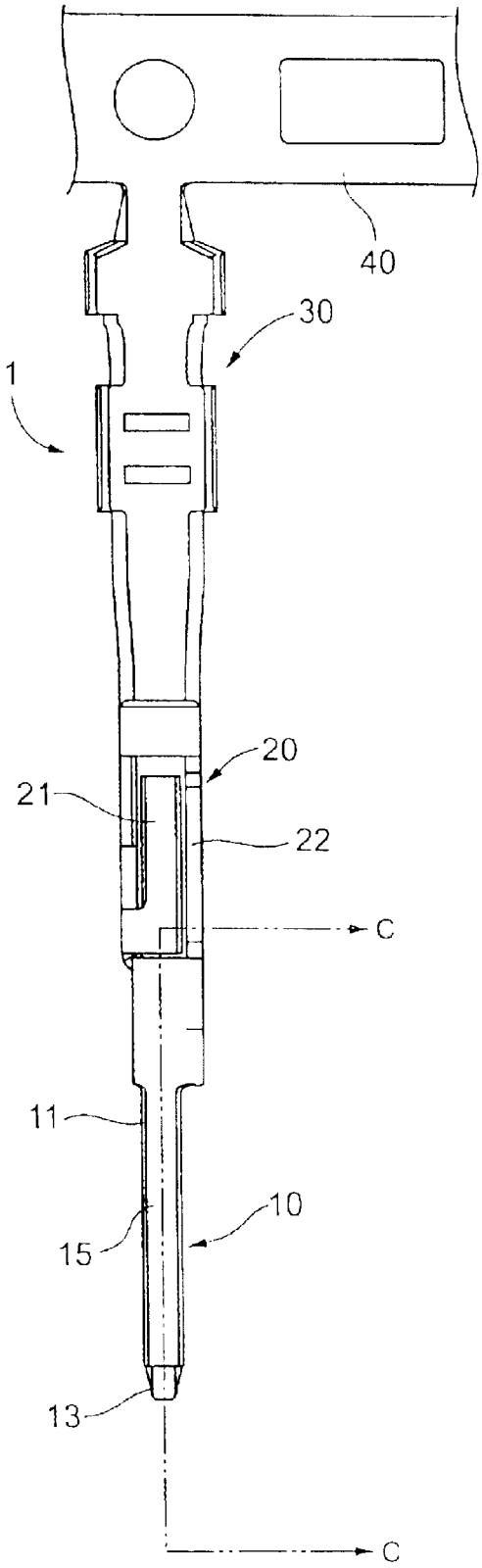
FIG. 3 is a plan view of the male contact of FIG. 1.
Figure 4:
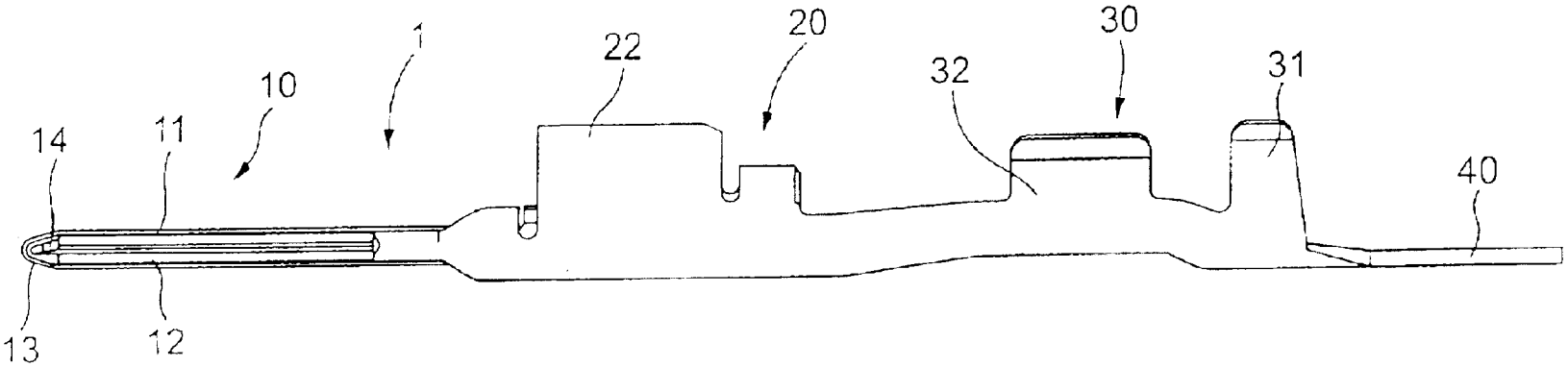
FIG. 4 is a right side elevation of the male contact of FIG. 1.
Figure 5:
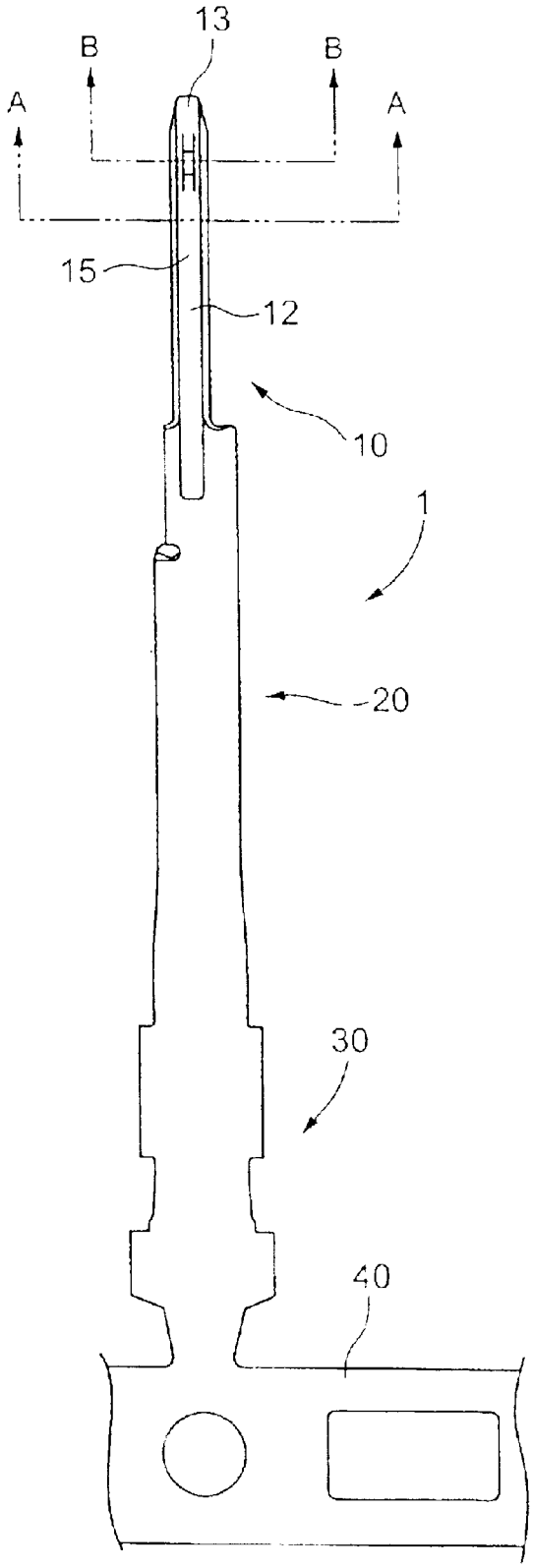
FIG. 5 is a bottom view of the male contact of FIG. 1.
Figure 6:
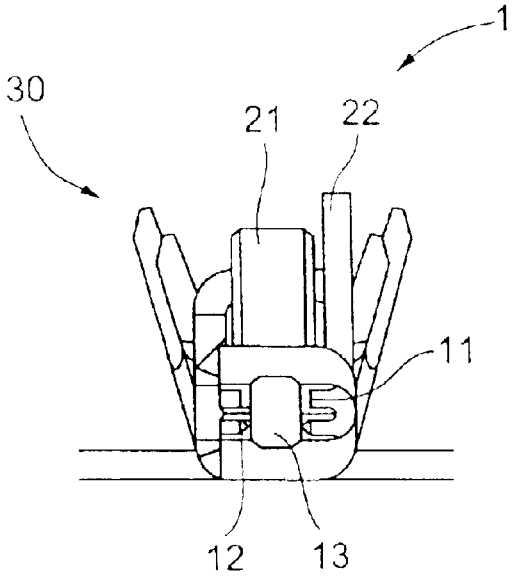
FIG. 6 is a front view of the male contact of FIG. 1.

As shown in FIG. 2, a tip 13 of the plate member 12 of the lower side is folded to overlap on a tip 14 of the plate member 11 of the upper side. This folding makes it possible to fix the plate members 11 and 12 on each other so as to not be separated in the vicinity of the tips. According to the present exemplary embodiment, thickness of the plate members 11 and 12 is 0.25 mm. Thus, if the tip 13 of the plate member 12 of the lower side is simply folded on the tip 14 of the plate member 11 of the upper side, thickness of this folding section would become about 0.75 mm. For this reason, as apparent from FIG. 9, the tips 14 and 13 of the plate members 11 and 12 are formed thin by coining and the like, and those thinner sections 13 and 14 are superimposed each other, so that the plate thickness is formed within a desired value (according to the exemplary embodiment, 0.64 mm). Alternatively, it is acceptable that shapes of the tips 13 and 14 of the plate members 11 and 12 are formed in such a way that when the plate members 12 and 11 are superimposed each other, the tips 13 and 14 are mutually staggered in the right and left of FIG. 3 such that the tip 13 of the plate member 12 of the lower side is obliquely folded to the side of the plate member 11 of the upper side and the tip 14 of the plate member 11 of the upper side is obliquely folded to the side of the plate member 12 of the lower side. The tip of one of the plate members 11 and 12 is therefore overlapped with the tip of the other.

Figure 8:
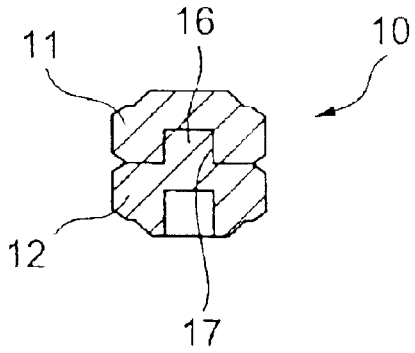
FIG. 8 is a sectional view taken along the line B—B of FIG. 5.
Figure 9:
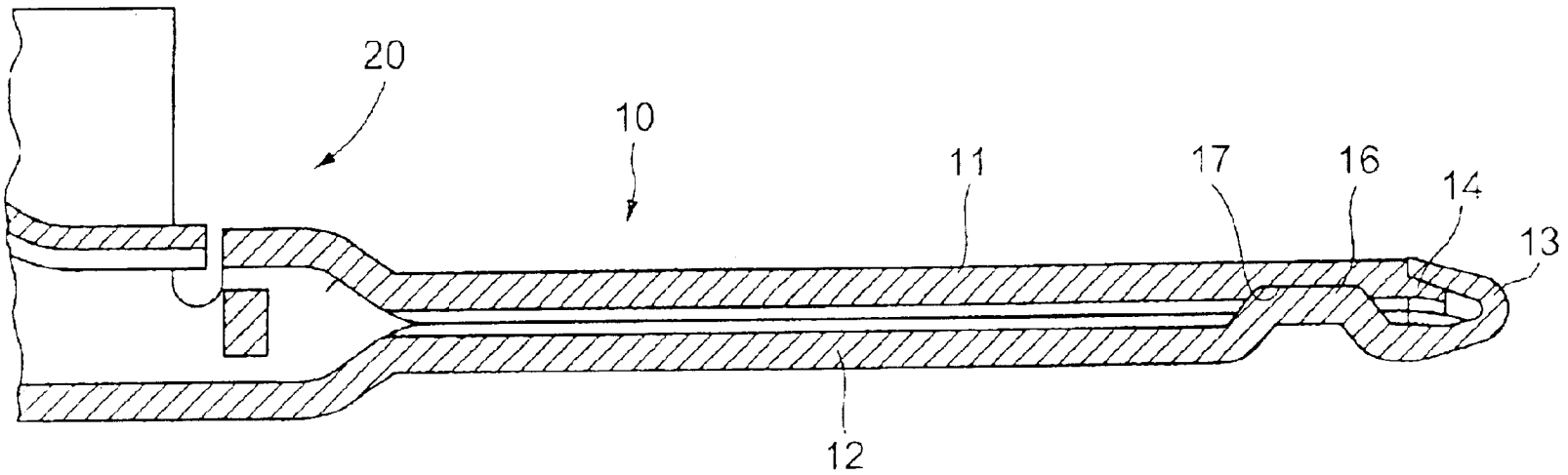
FIG. 9 is a sectional view taken along the line C—C of FIG. 3.
Figure 10:
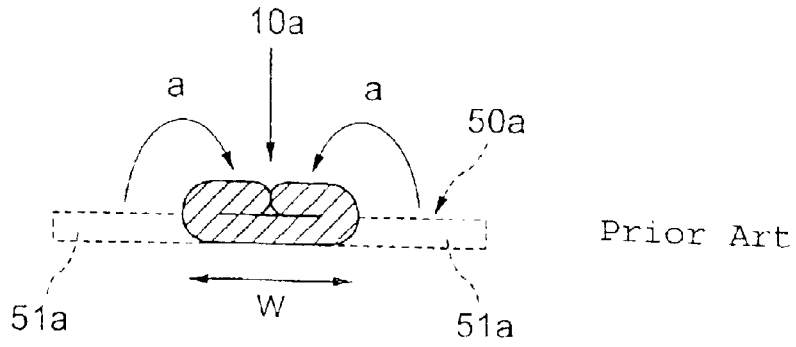
FIG. 10 is a sectional view of a mating section of the conventional male contact taken along the direction perpendicular to the mating direction.
Figure 11:
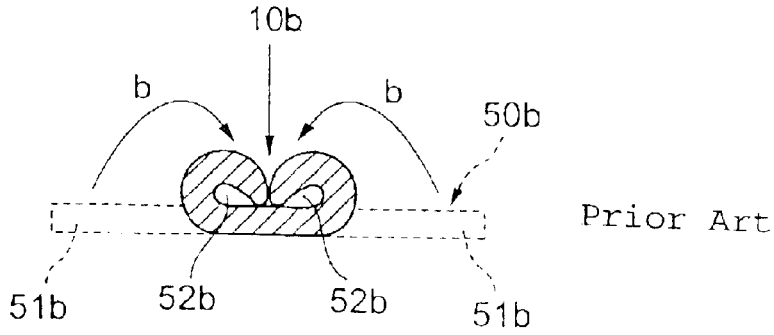
FIG. 11 is a sectional view of a mating section of another conventional male contact taken along the direction perpendicular to the mating direction.
Figure 12:
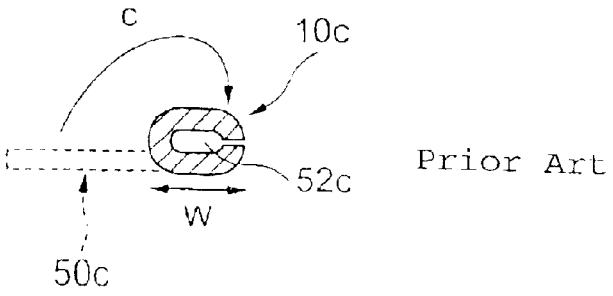
FIG. 12 is a sectional view of a mating section of further another conventional male contact taken along the direction perpendicular to the mating direction.
Figure 13:
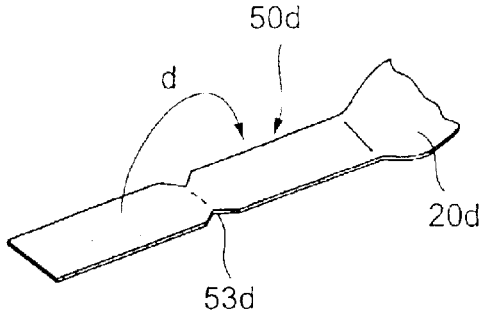
Fig.13 Prior Art
FIG. 13 is a perspective view showing a state of a mating section of the conventional another male contact before the folding processing.
Figure 14:
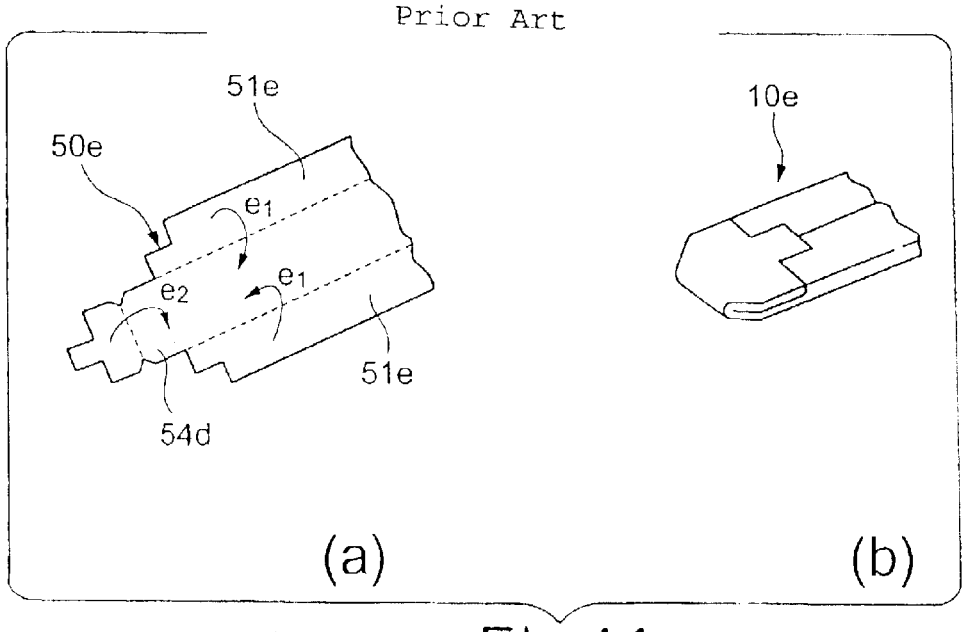
FIG. 14 shows another conventional male contact. Part (a) of FIG. 14 is a perspective view showing a state of the mating section before bending processing of the mating section of the male contact. Part (b) of FIG. 14 is a perspective view showing a state of the mating section after the bending processing of the mating section of the male contact.

As shown in FIG. 8 and FIG. 9, in the vicinity of the center of the plate member 12, there is provided a projecting portion 16 projecting toward the plate member 11. The plate member 11 is provided with a recess portion 17, which receives the projecting portion 16. The projecting portion 16 and the recess portion 17 are formed by pressing before superimposing the two plate members 11 and 12, and are mated by superimposing those two plate members 11 and 12. Mating of the projecting portion 16 and the recess portion 17 may prevent the mutual deviation of the two plate members 11 and 12 in a horizontal direction perpendicular to the mating direction P (FIG. 1).

On the male contact 1, a base 20 and a wire connecting section 30 are formed. As shown in FIG. 2, the base 20 has a lance 21 for fixing the male contact 1 on a housing (not illustrated) and a stabilizer for stabilizing the posture of male contact 1 with in the housing. The wire connecting section 30 has an insulation barrel 31 for fixing a covering section (not illustrated) of a wire and a wire barrel 32 electrically connecting with a core of a wire. The insulation barrel 31 and the wire barrel 32 apply the covering section and the core wire respectively by a folding processing.

Incidentally, according to the present embodiment, the thinner plate thickness of the plate members 11 and 12, the more saving of materials and processing (fabrication) of the male contact 1 becomes easier. Thus, the male contact 1 is fabricated with a metallic material having the lowest plate thickness satisfying a desired strength as a result of a strength computation. On the other hand, width and height of the mating section are defined by a standard. According to the present exemplary embodiment, in order to provide the lowest plate thickness satisfying a desired strength for a plate thickness of the plate member and also satisfy conditions of width and height of the mating section defined, as shown in FIG. 7, there are provided legs 18 obliquely standing with respect to the opposite direction to the associated plate member in the is vicinity of both the edges extending along the respective mating direction P (FIG. 1).

Inclined sections 18-1 are formed such that the mating section 10 has a thickness of 0.64 mm using two plate members each having the plate thickness 0.25 mm according to the present exemplary embodiment. Inclined sections 18-1 also serve to round off the corners of the edge portions extending along the mating direction P of the mating section 10. This feature makes it possible to prevent the female contact from being damaged at the time of mating. Further, as the legs 18 are formed, a cavity 19 is formed in the vicinity of the center axis of the mating section 10 extending the mating direction P so that the same effect as forming of beads on the plate members 11 and 12 is obtained. This feature makes it possible to enhance the mechanical strength of the mating section 10.

While the above explanation is made for the preferred embodiment of the present invention, the present invention is not restricted to the present embodiment, and can be modified within the spirit of the present invention as an occasion arises. For example, it is acceptable that the tip of the plate member 11 of the upper side is folded on the tip of the plate member 12 of the lower side. Alternatively, it is acceptable that the plate member 11 of the upper side is provided with a projecting portion projecting toward the plate member 12 of the lower side, and the plate member 12 of the lower side is provided with a recess portion mating with the projecting portion.

What is claimed is:

1. A male contact formed by folding a sheet of metallic plate comprising:

a base;

a mating section adapted to mate with a female contact;

said mating section being formed by two plate members, which individually extend from said base, being superimposed on one another by folding on said base;

said two plate members superimposed on one another each having a flat section extending in a mating direction and formed flat on an associated outer surface opposite to surfaces on which said two plate members are in contact with one another; and, a tip of one of said two plate members is folded to overlap a tip of the other plate member.

2. A male contact according to claim 1, wherein said mating section has a projecting section on one of said two plate members superimposed on one another, said projecting section projecting toward the other of the two plate members, and a recess portion adapted to mate said projecting section with said other plate member.

3. A male contact comprising:

a base;

a mating section extending from the base having a pair of plate members which are folded to be superimposed on each other;

each plate member having an outer flat section positioned opposite an inner surface which is in contact with the other of the pair of plate members; and, a tip located at a distal end and extending from one of the plate members and being folded to overlap a free end of the other of the pair of plate members.

4. The male contact of claim 3 further comprising a projecting section extending from one of the plate members toward the other of the plate members.

5. The male contact according to claim 4 further comprising a recess located on the inner surface of the other one of the plate members portion being adapted to receive the projection section.

6. The male contact of claim 3 further comprising a pair of inclined sections extending from each flat section along the outer surface near edges thereof.

7. The male contact of claim 6 further comprising a gap formed between each of the plate members.

8. The male contact of claim 6 wherein the overall thickness of the mating section as measured between the two flat surfaces is greater than the sum of the thicknesses of the two plate members.

9. The male contact of claim 3 further comprising a lance extending from the base for mounting the male contact.

* * * * *